US008166929B2

(12) United States Patent
Pattakos et al.

(10) Patent No.: US 8,166,929 B2
(45) Date of Patent: May 1, 2012

(54) VARIABLE COMPRESSION RATIO ENGINE

(76) Inventors: Manousos Pattakos, Nikea Piraeus (GR); Chrysavgi Pattakou, Aharnai Athens (GR); Emmanouel Pattakos, Nikea Piraeus (GR)

( * ) Notice: Subject to any disclaimer, the term of this patent is extended or adjusted under 35 U.S.C. 154(b) by 688 days.

(21) Appl. No.: 12/404,355

(22) Filed: Mar. 16, 2009

(65) Prior Publication Data

US 2010/0229834 A1 Sep. 16, 2010

(51) Int. Cl.
*F02B 75/04* (2006.01)

(52) U.S. Cl. ..... 123/48 C; 123/78 C

(58) Field of Classification Search ..... 123/48 R, 123/48 C, 78 R, 78 C

See application file for complete search history.

(56) References Cited

U.S. PATENT DOCUMENTS 6,880,499 B2 * 4/2005 Hoffmann et al. ..... 123/48 C

FOREIGN PATENT DOCUMENTS

DE 4211589 A1 * 10/1993

* cited by examiner

*Primary Examiner* — Noah Kamen

(57) ABSTRACT

To control the compression ratio of an internal combustion engine, the cylinder block is slidably fitted to the crankcase, projections from the crankcase extend into the cylinder head to support a control shaft bearing the cylinder head. The angular displacement of the control shaft varies the compression ratio by displacing the cylinder head relative to the crankcase.

10 Claims, 14 Drawing Sheets

VARIABLE COMPRESSION RATIO ENGINE

BACKGROUND OF THE INVENTION

In the prior art, like SAAB's PCT/SE91/818 and Toyota's U.S. Pat. No. 7,047,917, a pair of connecting shafts is arranged at the two sides of the cylinder block, laterally, to connect the upper and lower sections of the engine. The rotation of a control shaft displaces the cylinder head relative to the crankcase to vary the compression ratio. The inevitable long distance between the two connecting shafts generates heavy bending loads, flexing and noise, making the reinforcement of the two sections inevitable.

BRIEF SUMMARY OF THE INVENTION

In this patent, a variable compression ratio internal combustion engine comprises a base section and a movable section slidably fitted to each other.

The movable section comprises a cylinder head and a cylinder block.

The base section comprises a crankcase, or a casing in general. There are projections of the crankcase into the cylinder head to provide supports for receiving the forces applied to the cylinder head from the high-pressure gas into the combustion chamber. These projections comprise pillars starting near the crankshaft base bearings and entering, through proper openings, into the cylinder head, they also comprise bridges firmly interconnecting the free ends of the pillars to strengthen the structure and to provide supports to a control shaft.

In the conventional cylinder block the narrowing between neighboring cylinders is an available free area for the pillars. Bearing the cylinder head, the pillars are loaded purely in tension and connect, as directly as desirable, the tightening screws of the crankshaft bearing caps to the tightening screws of the bridges. Limited to the bridges, the bending loads are no heavier than those in the crankshaft bearing caps, i.e. there is nothing special regarding the size or the design of the bridges.

The control shaft has eccentric pins or cams or toothed gears etc. The crankcase bears the control shaft and the control shaft bears the cylinder head, longitudinally.

The architecture of the crankcase projections fits the direction of the gas pressure forces on the cylinder head, resulting in pure tensile loading of the pillars.

There are sliders on the cylinder block, at the height where the piston skirts thrust the cylinder walls. These sliders thrust on respective crankcase sliders in order to pass the thrust loads of the cylinder block onto the crankcase. These loads are several times weaker than those on the cylinder head. The pillars of the crankcase projections can serve as the crankcase sliders, too. The bridging of the free ends of the pillars and the small distance of the thrust loads from the crankcase side of the pillars improve the thrust load capacity of the structure.

The cylinder block, being free from transferring to the crankcase the forces applied on the cylinder head, becomes lighter and distortion free. The forces tending to separate the cylinder head from the cylinder are small enabling the reliable sealing of the combustion chamber. The union of the cylinder head with the cylinder block in a single piece is a further option, better as regards the cooling, the simplicity, the robustness, the cost and the reliability.

The control shaft is pivotally mounted either on the cylinder head or on the crankcase projections. The control shaft supported on the crankcase projections directly, or by connecting rods sliders and the likes, receives the forces applied on the cylinder head and supports the cylinder head. The angular displacement of the control shaft varies the compression ratio by displacing the cylinder head relative to the crankshaft.

BRIEF DESCRIPTION OF THE SEVERAL VIEWS OF THE DRAWING(S)

FIG. 1 shows the engine partly sliced.

FIG. 2 shows the base section and the movable section separated, with the control shaft between them.

FIG. 3 shows the movable section disassembled and the bearings for mounting the control shaft.

FIG. 4 shows the control shaft and the bridges of the pillars.

FIG. 5 shows the crankcase, the projections of the crankcase and the parts for the connection of the crankcase to the control shaft.

FIG. 6 shows the control shaft, the lower bearings of the crankshaft, the bridges of the pillars and the straight way for passing the loads.

FIG. 7 shows the robust, yet compact and light, structure of the crankcase.

FIG. 8 shows sections of the engine.

FIG. 9 shows the section D-D of FIG. 8 exploded.

FIG. 10 shows the engine partly sliced, a bearing cup from the other side, the timing belt and the sprockets.

FIG. 11 shows the crankshaft, the connecting rods and the pistons of the engine, the control shaft, the bridges and the direct passing of the loads from the cylinder head, through the pillars, to the lower bearings of the crankshaft.

FIG. 12 shows at top the bridges and the control shaft, at middle the cylinder head and at bottom the crankcase with its pillars.

FIG. 13 shows details of the control shaft, the bridges, the sliders and the roller bearings.

DETAILED DESCRIPTION OF THE INVENTION

Figure 1:
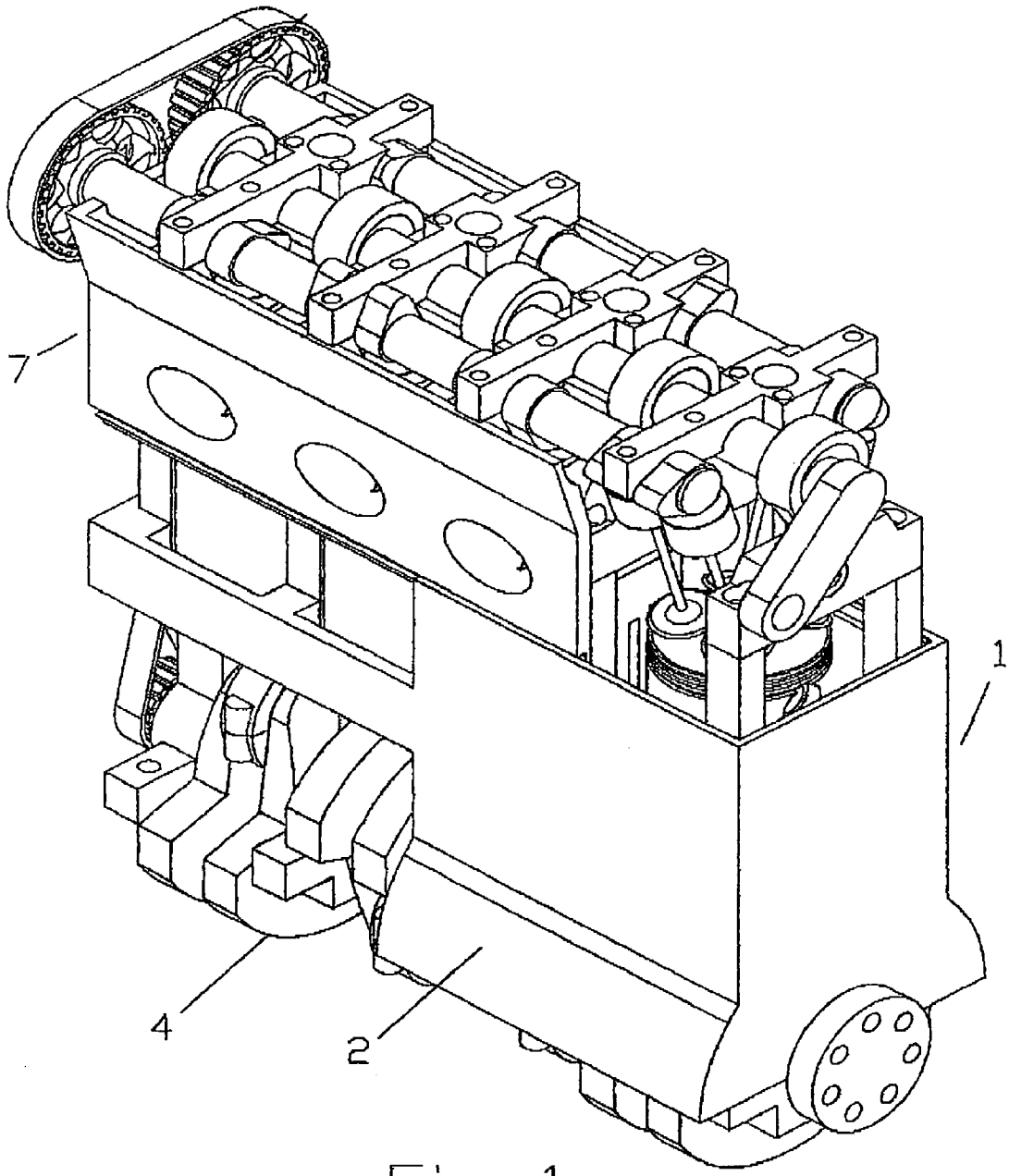
FIGS. 1 to 9 show a first embodiment.
Figure 2:
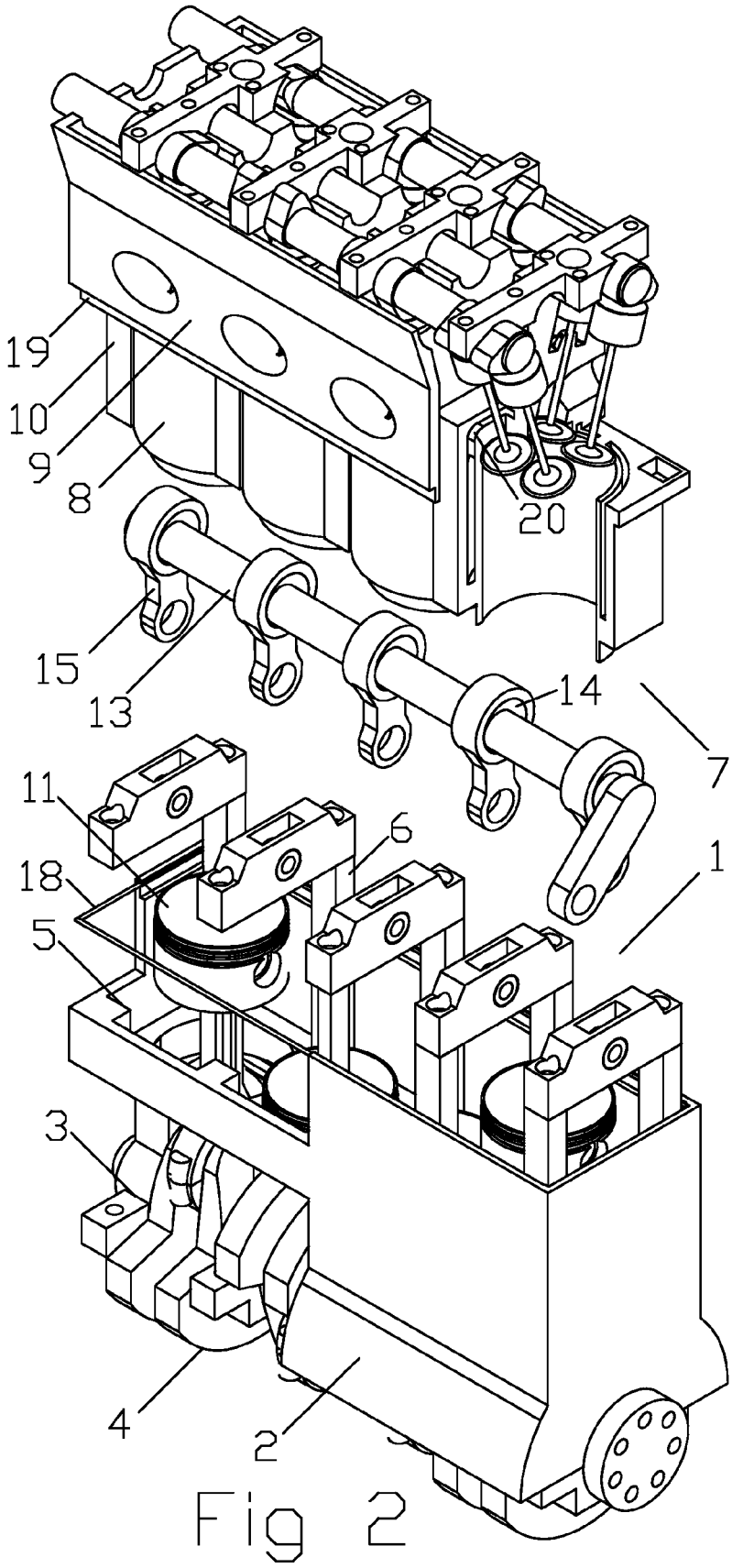
Figure 3:
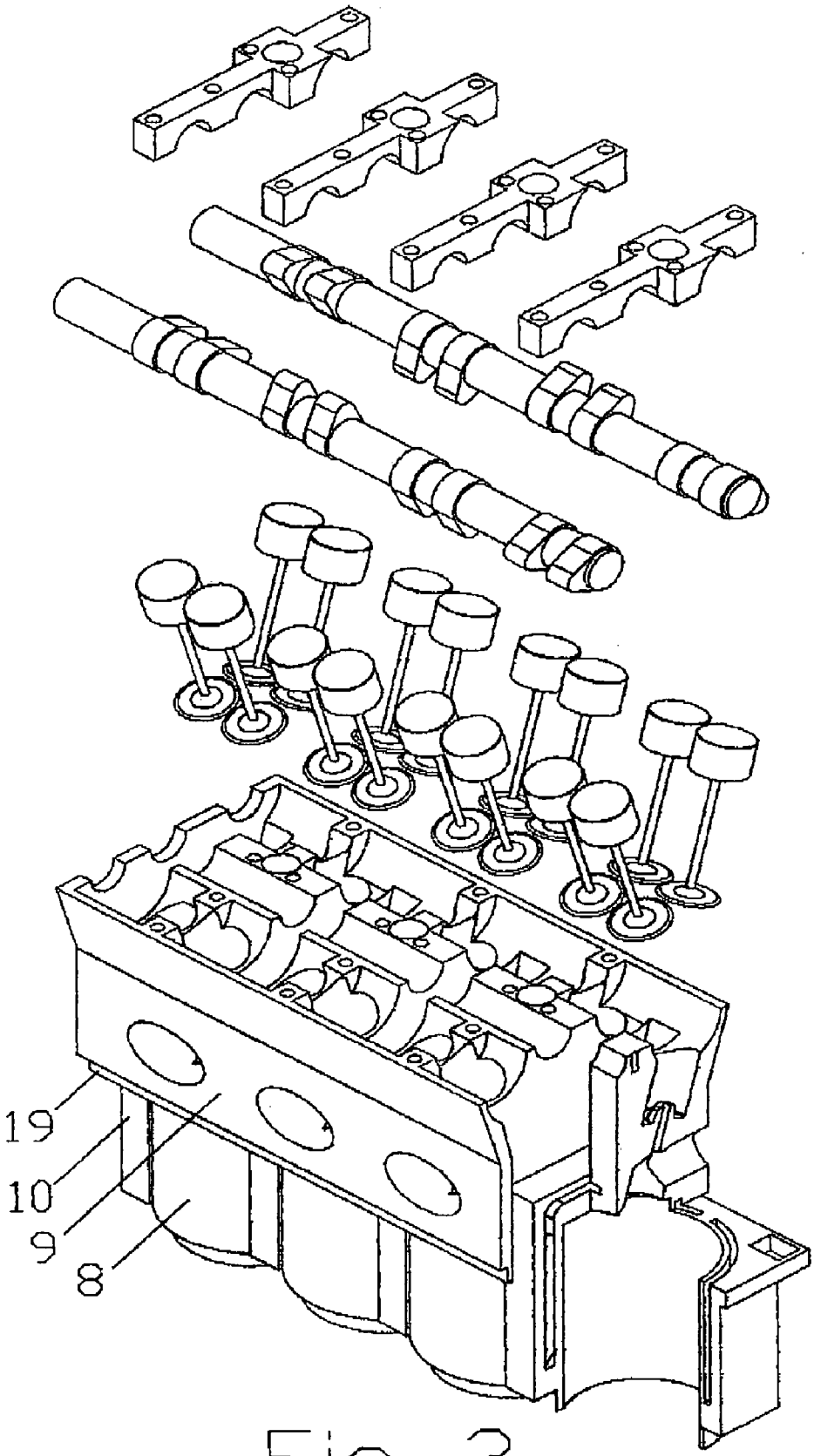
Figure 4:
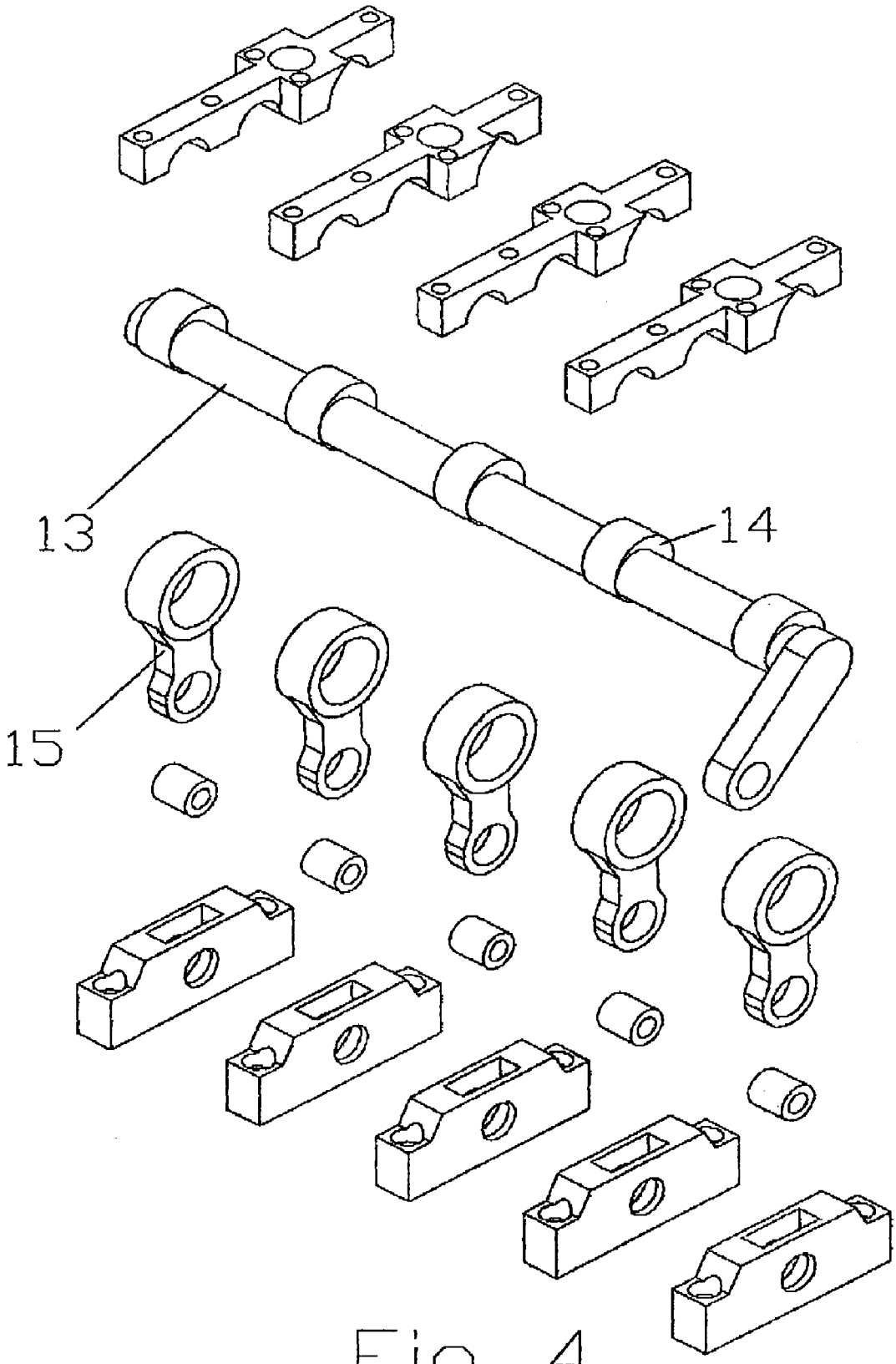
Figure 5:
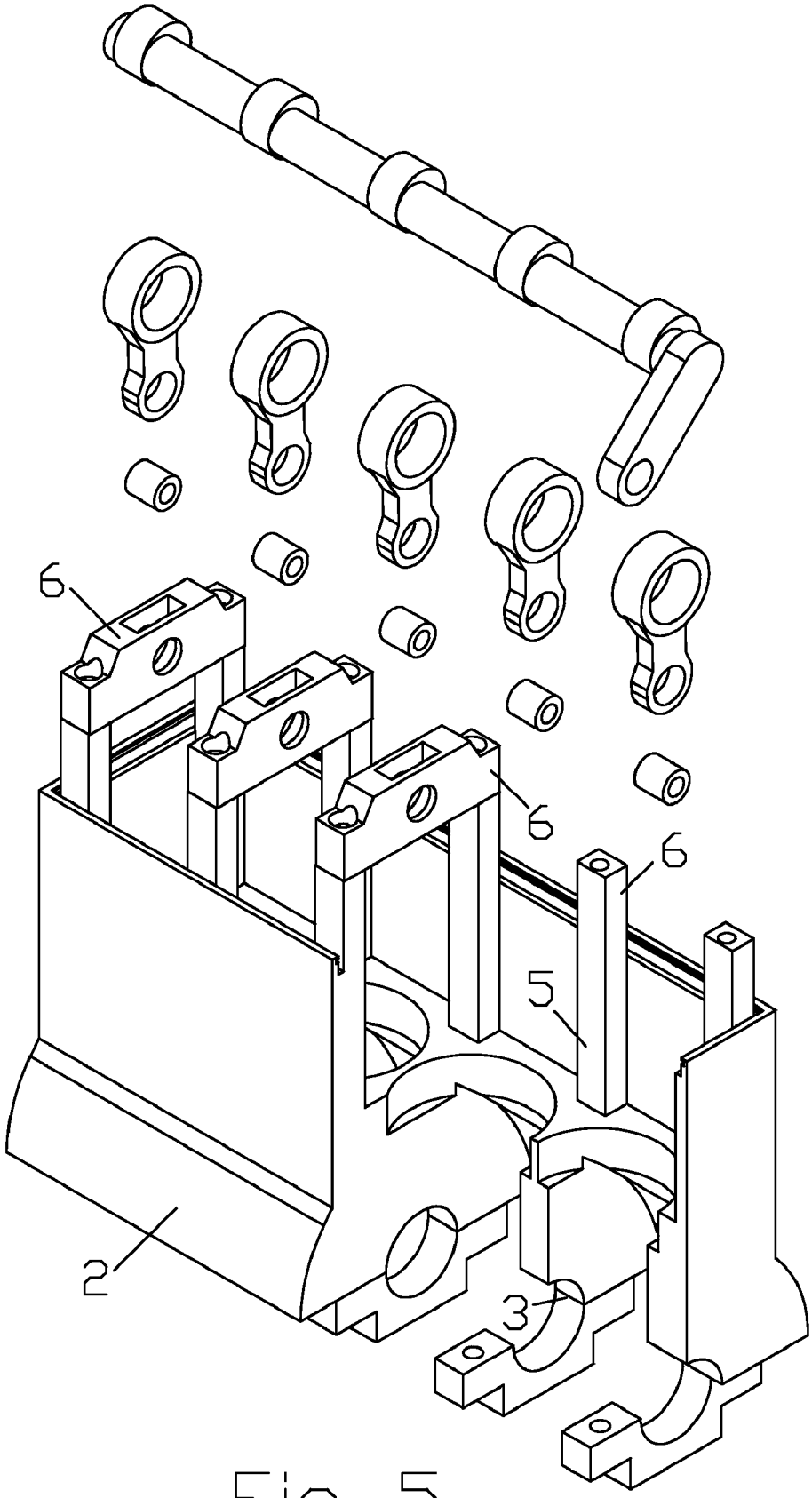
Figure 6:
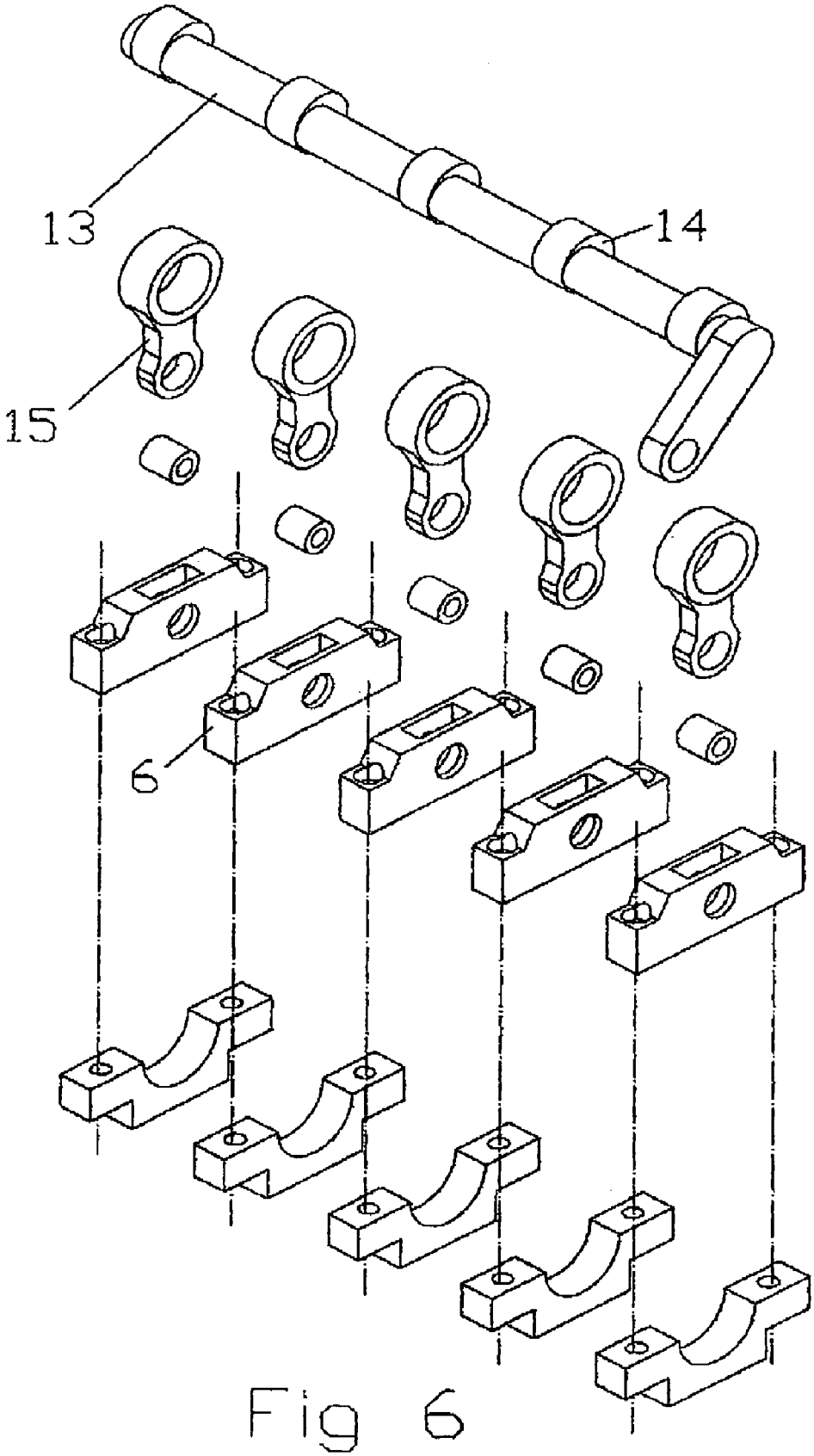
Figure 7:
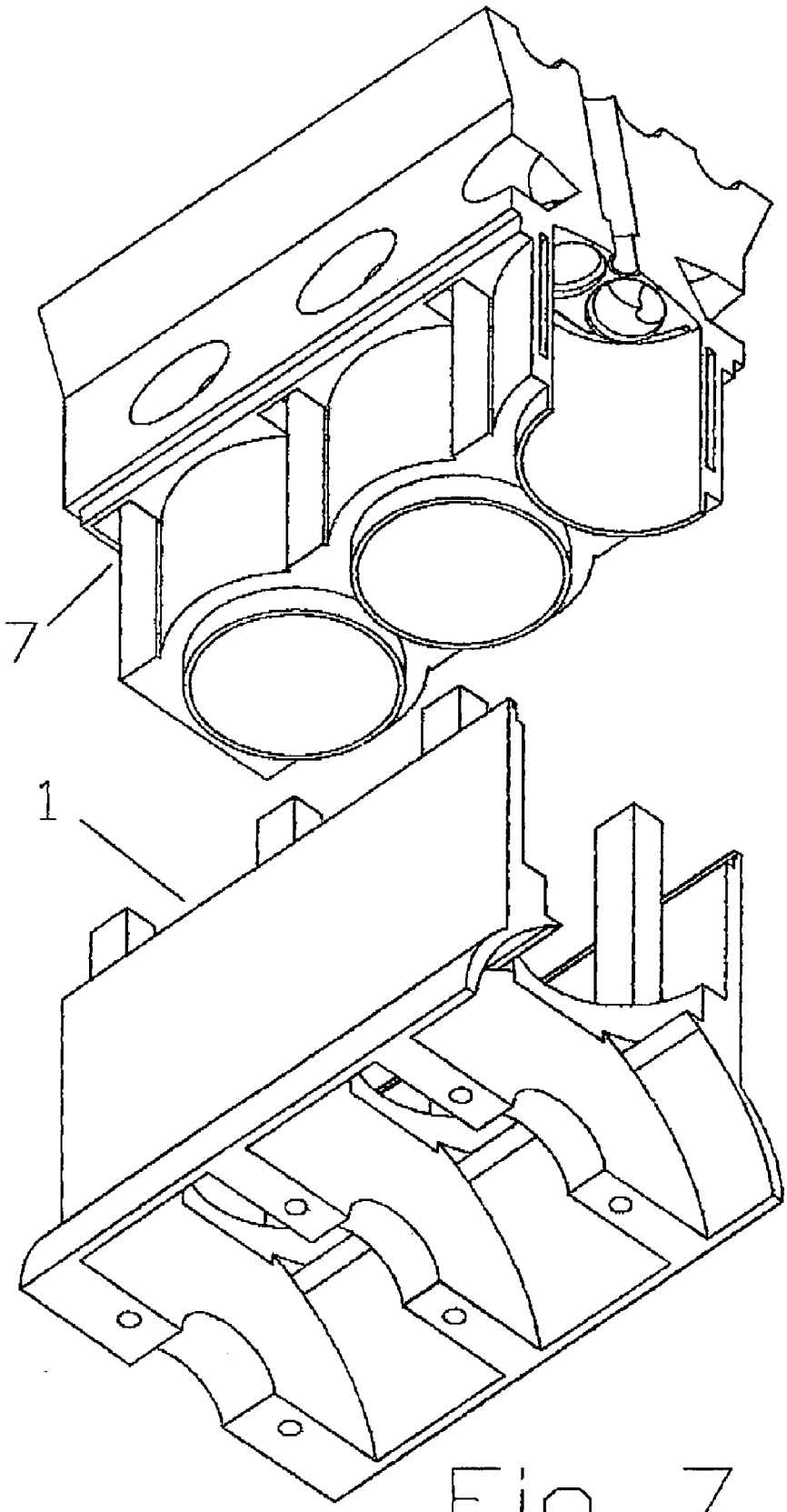
Figure 8:
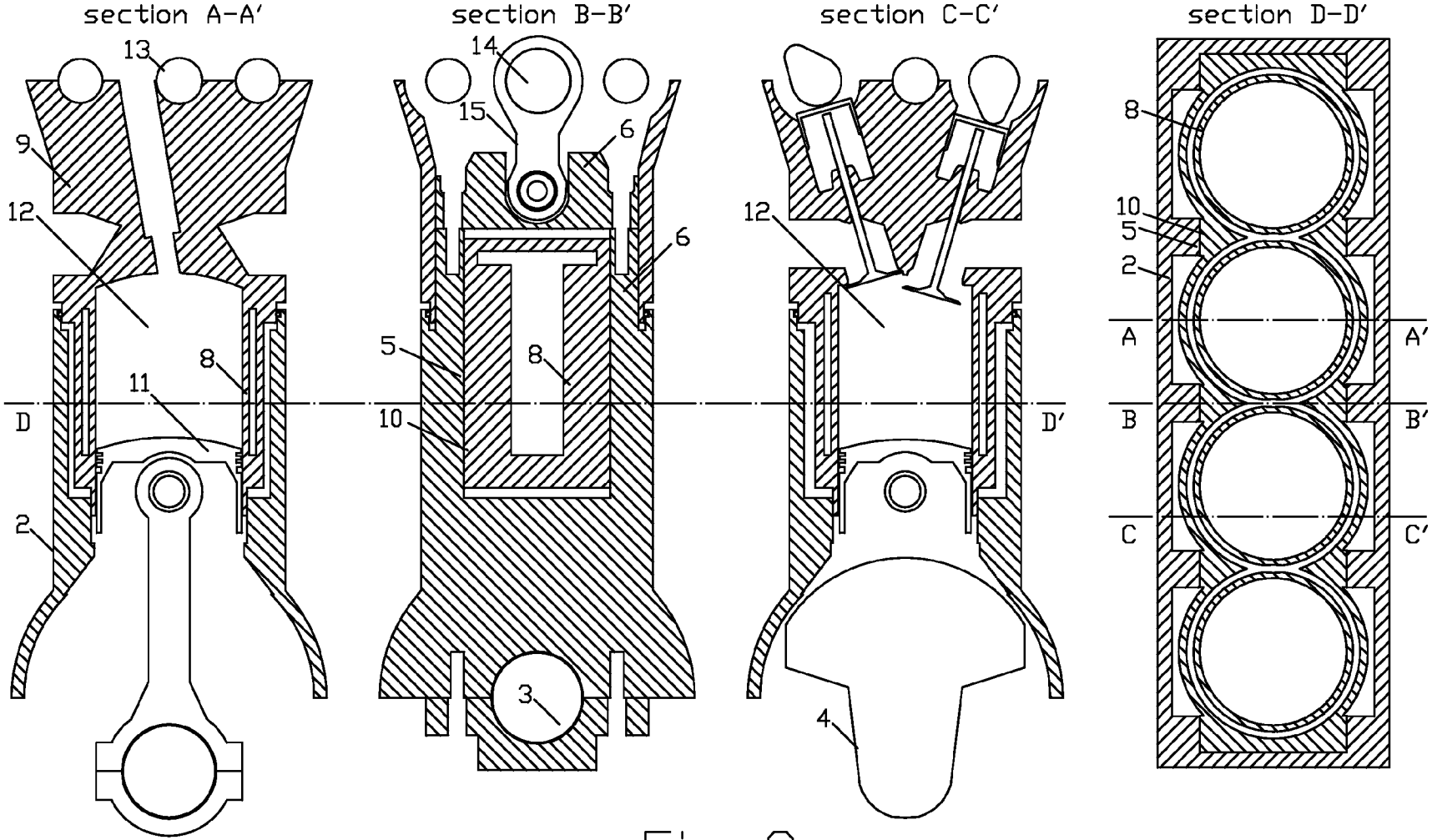
Figure 9:
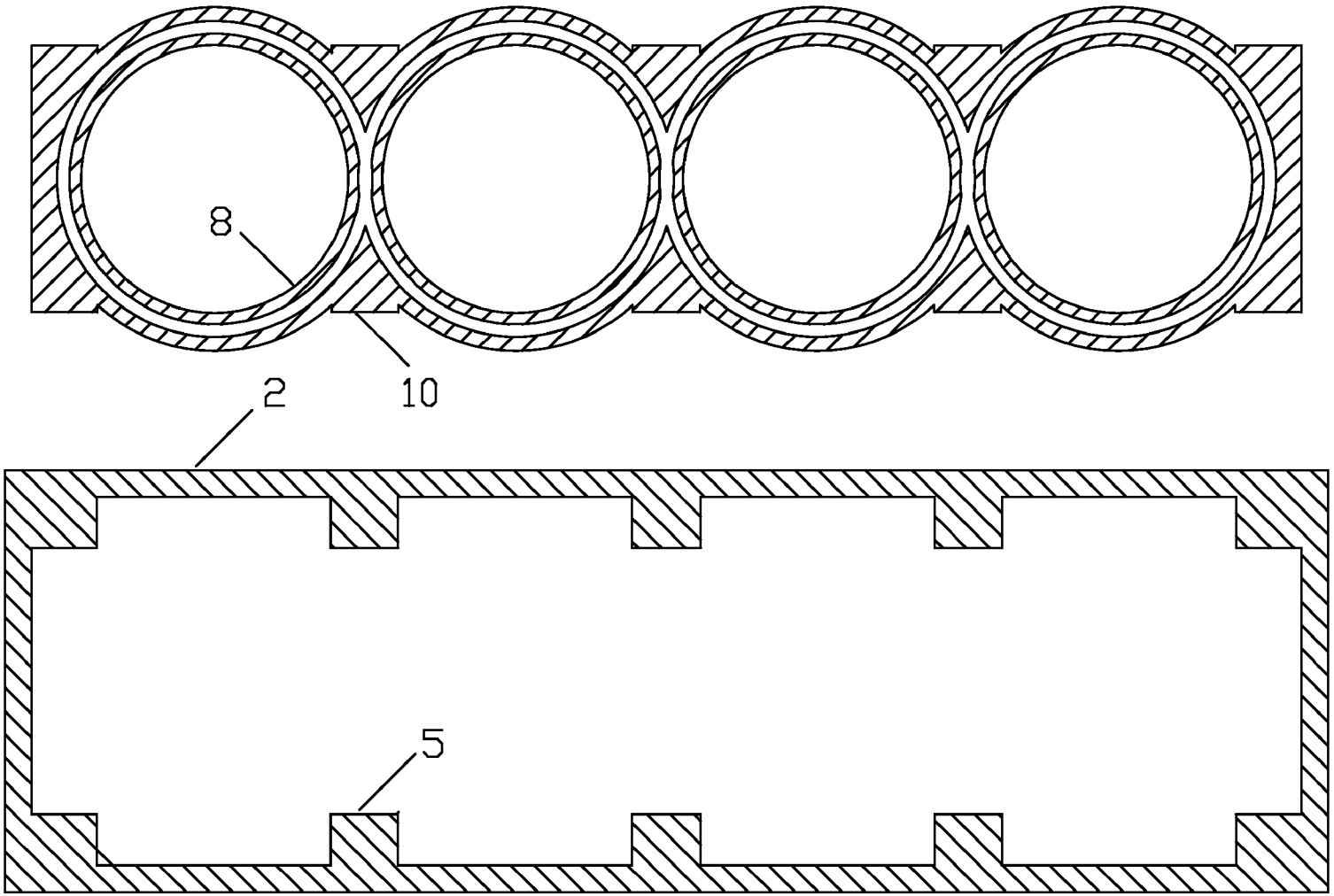

In a first embodiment, on top of the cylinder head 9 of the movable section 7, a control shaft 13 is pivotally mounted in the space between the two camshafts, leaving space for a centrally located spark in the combustion chamber 12.

The crankcase 2, of the base section 1, has projections 6 comprising pillars and bridges.

The control shaft has eccentric pins 14.

The connecting rods 15 are pivotally mounted at one end on said eccentric pins 14 and at the other end on the crankcase projections 6.

The movable section 7 is slidably fitted on the crankcase 2 by means of the cylinder sliders 10 and the crankcase sliders 5. The thrust loads of the cylinders pass through the cylinder sliders 10 to the crankcase 2.

The angular displacement of the control shaft displaces the cylinder head, relative to the crankshaft, varying the compression ratio. The control shaft receives the forces applied to the cylinder head and passes them, through the connecting rods 15, to the bridges, then to the pillars and finally to the lower crankcase. Compared to the gas pressure force carried by the connecting rod to the crankshaft 4, each pillar carries less than a quarter and each short connecting rod 15 carries less than half.

In a second embodiment, the control shaft 13 is pivotally mounted on the cylinder head by means of needle roller bearings and has eccentric pins 14. First sliders 16 are pivotally mounted on the eccentric pins 14, they are also slidably fitted into second sliders 17 formed in the bridges of the free ends of the pillars. The angular displacement of the control shaft 13 displaces the cylinder head 9 relative to the crankcase varying the compression ratio. All heavy loaded pivot joints and sliders can be of the needle roller bearing type to avoid lubrication issues.

Figure 10:
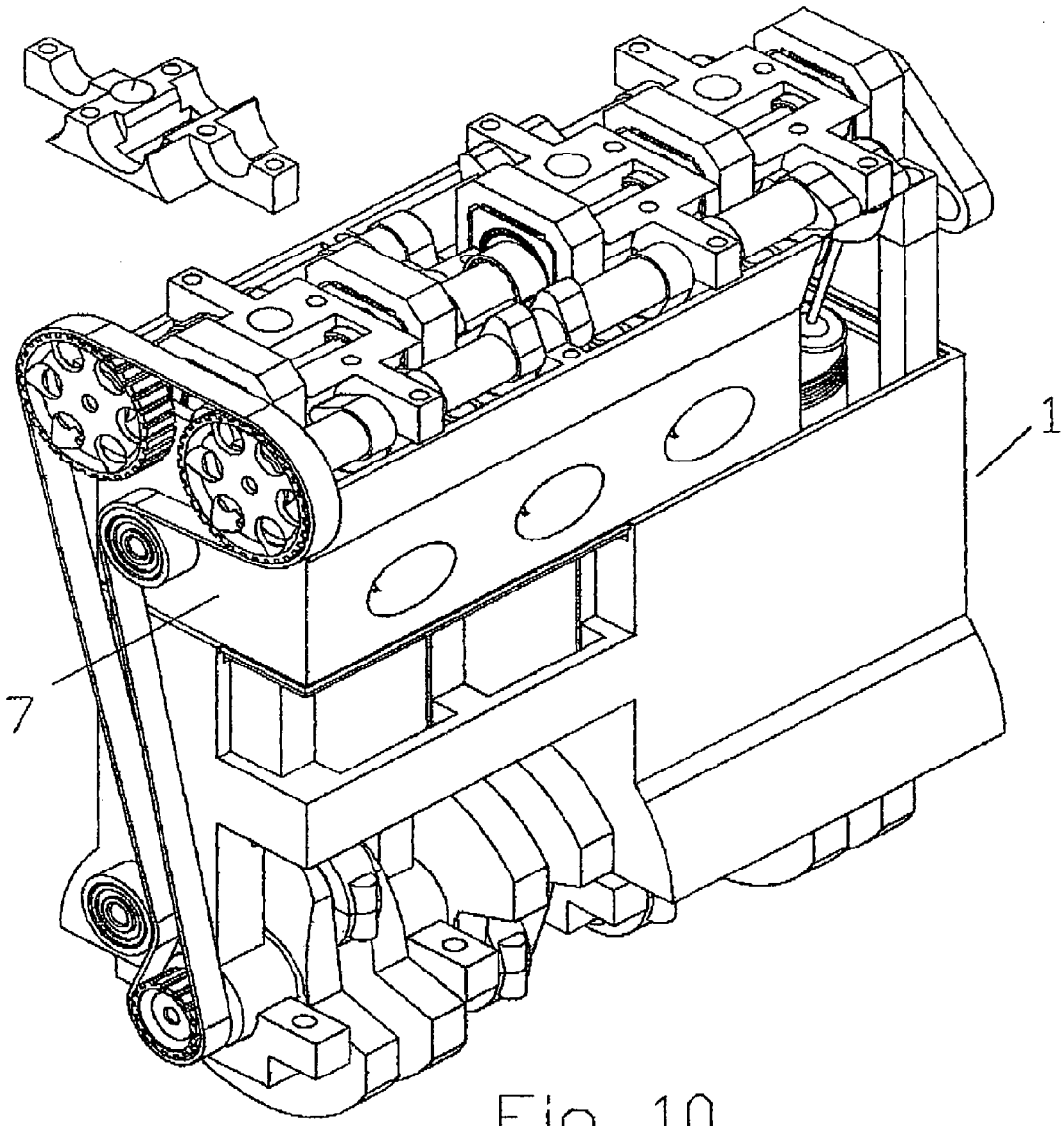
FIGS. 10 to 13 show a second embodiment.
Figure 11:
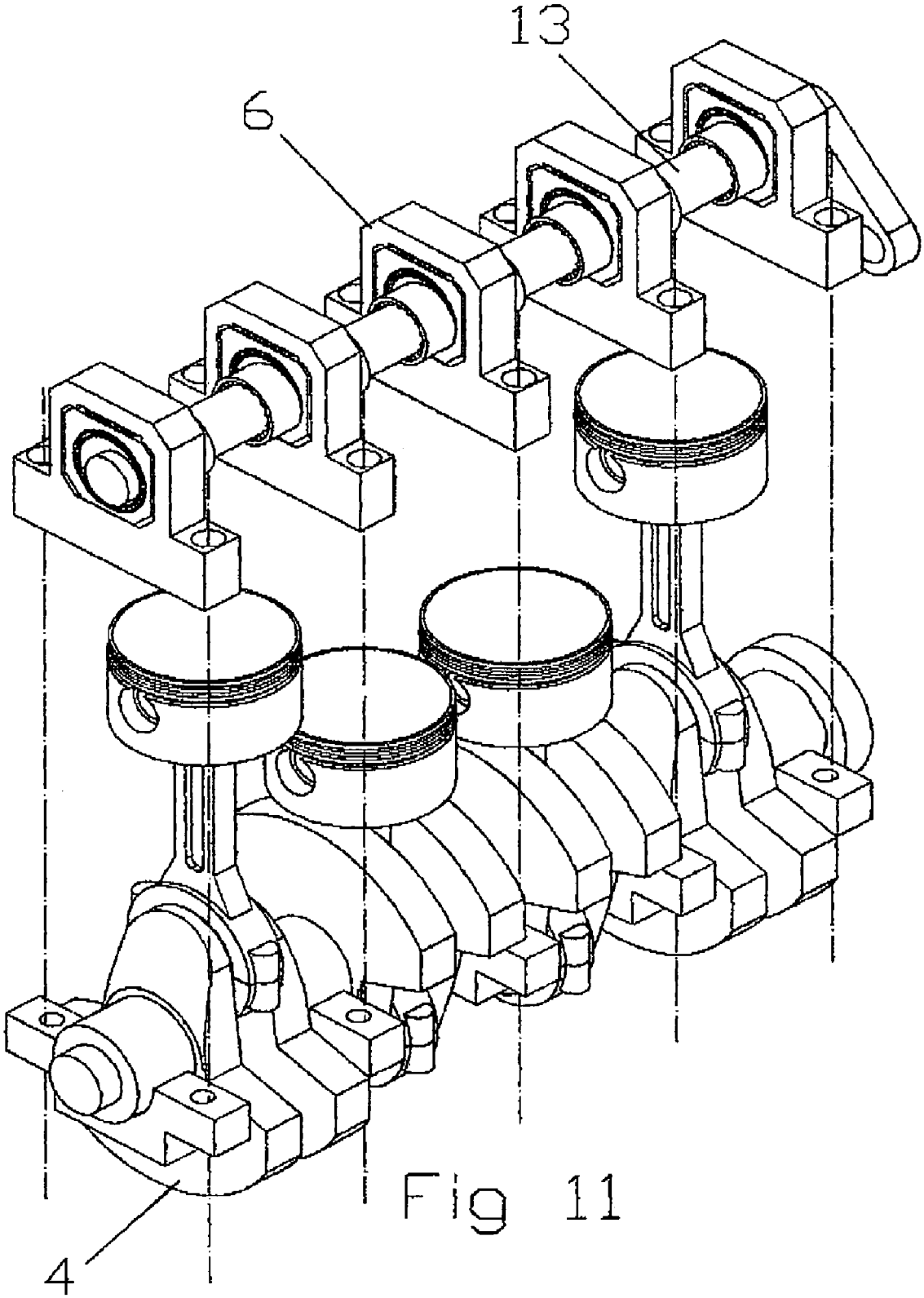
Figure 12:
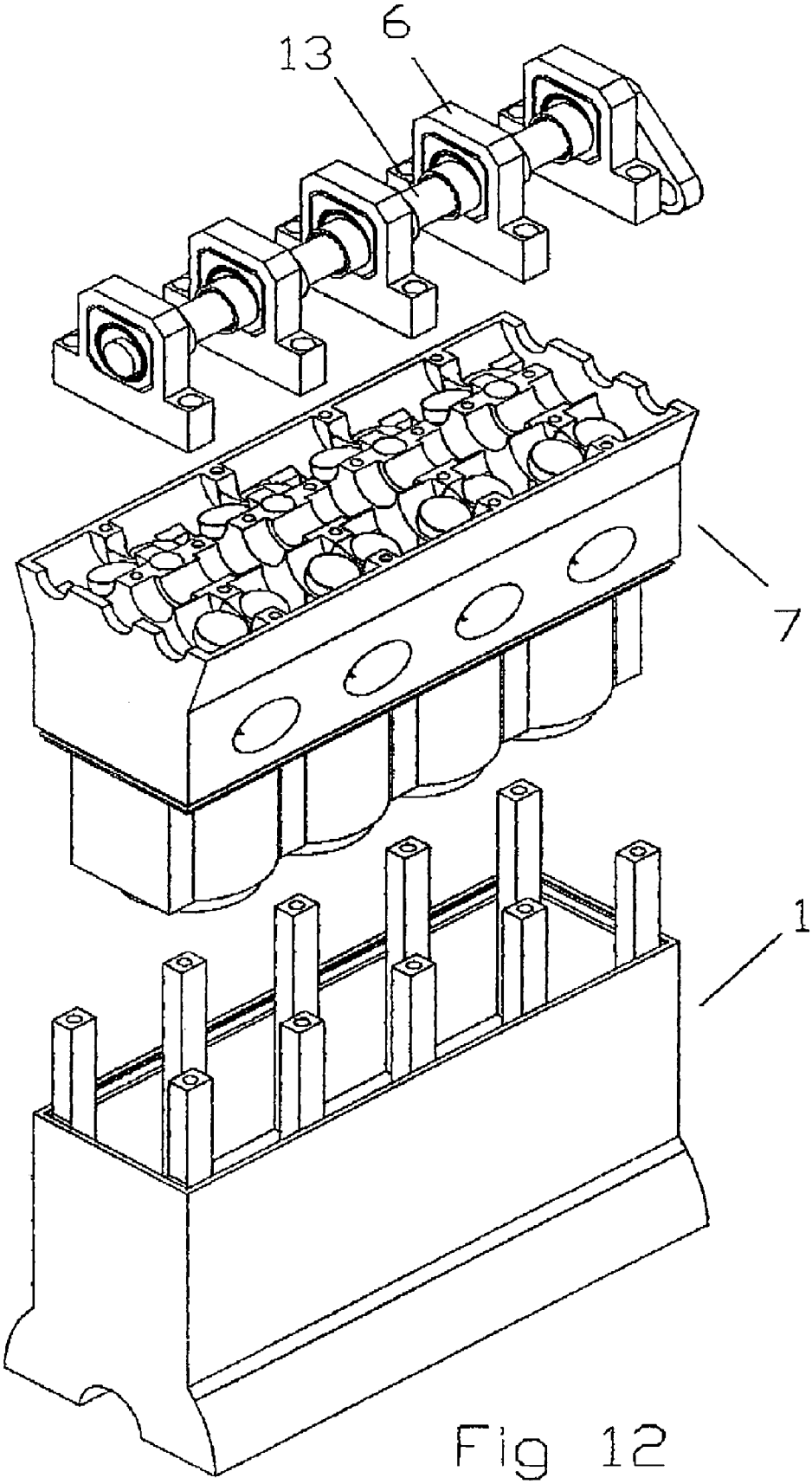
Figure 13:
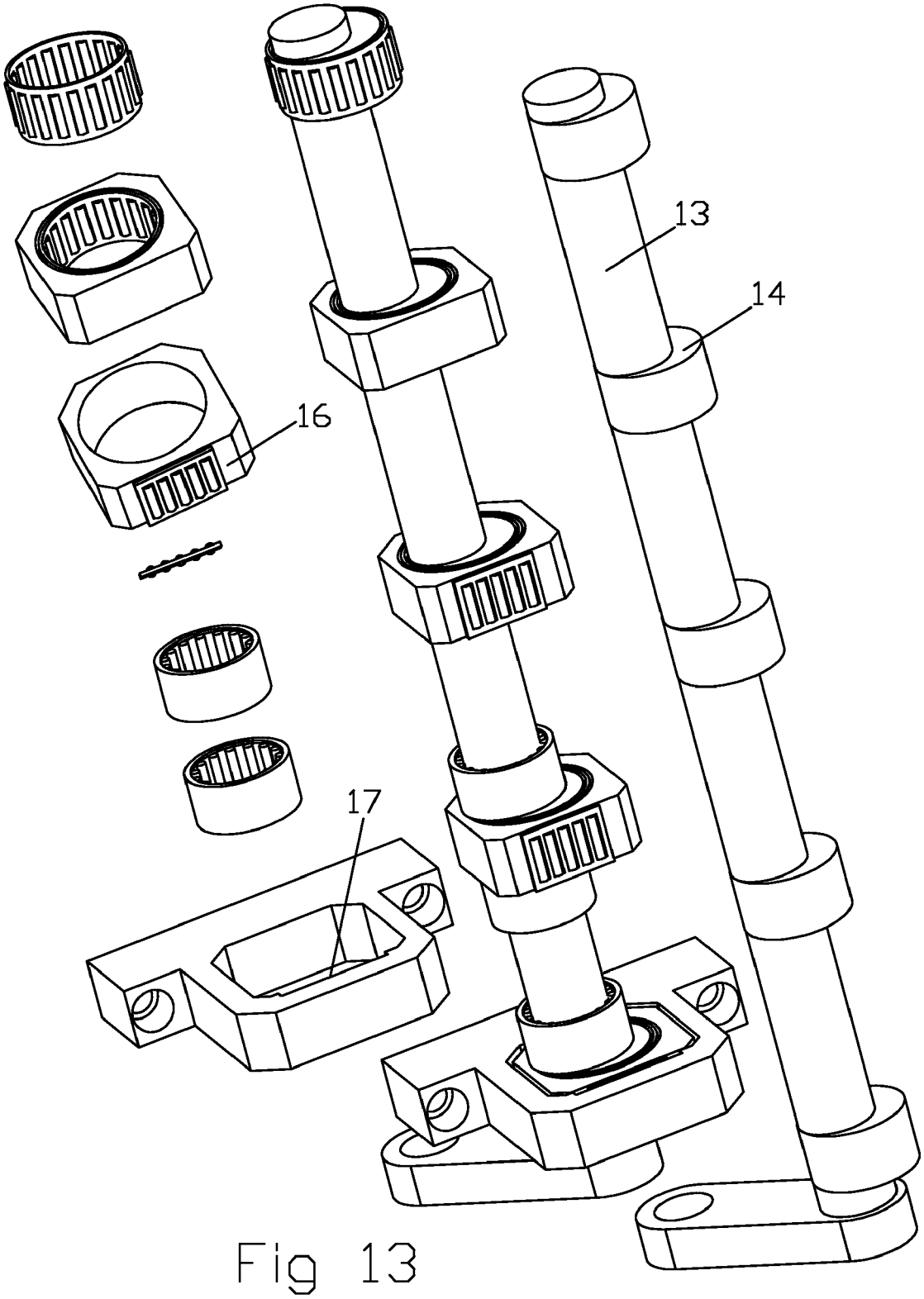
Figure 14:
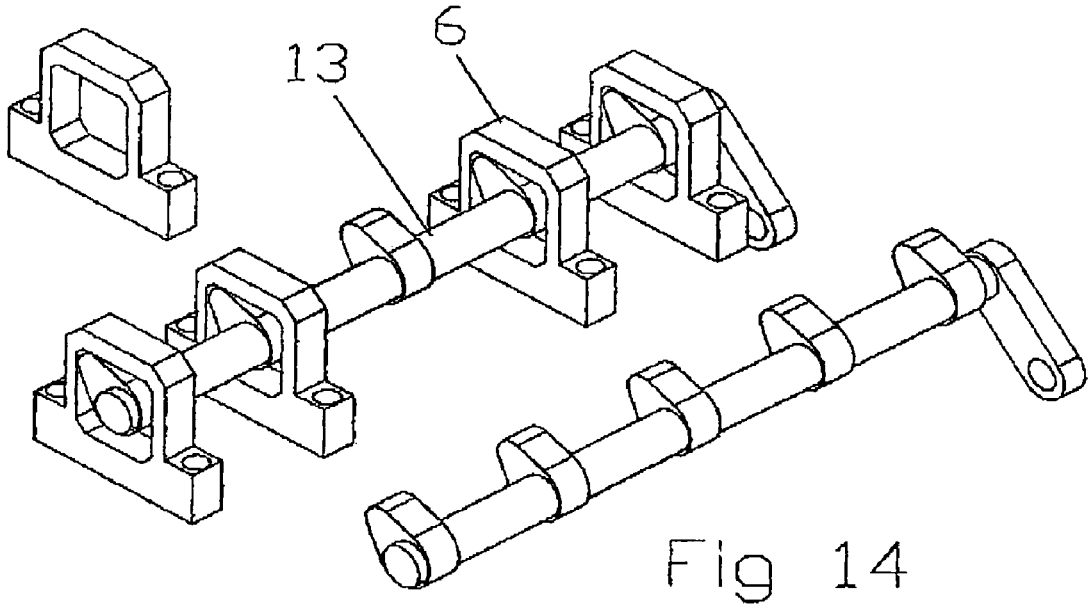
FIG. 14 shows a variation of the second embodiment.

The geometry of the arrangement of the timing belt shown in FIG. 10 can keep substantially unchanged the timing between the crankshaft and the camshafts. The roller just below the two camshaft sprockets has a shaft secured on the base section. The other roller, near the crankshaft, keeps the timing belt tight. In a variation of the second embodiment, FIG. 14, cams have replaced the eccentric pins of the control shaft. Under the camming action of said cams on the pillar bridges, the cylinder head is displaced and the compression ratio varies.

Figure 15:
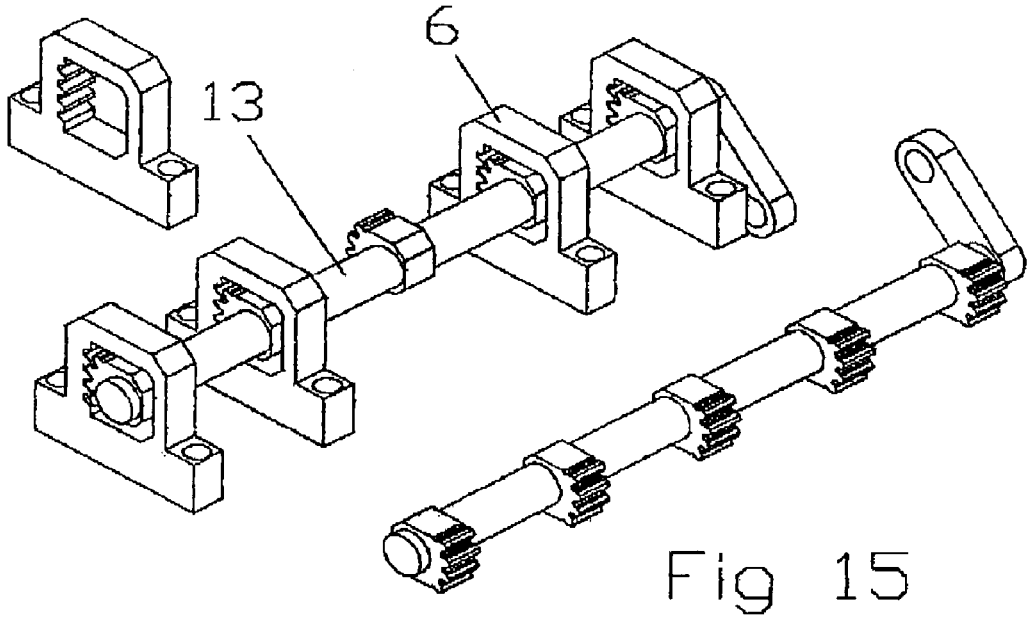
FIG. 15 shows another variation of the second embodiment.

In another variation of the second embodiment, FIG. 15, toothed gears have replaced the eccentric pins of the control shaft. The toothed gears are meshed to rack gears formed on the bridges.

The proper design of the crankcase projections neither restricts the size of the intake and exhausts ports, as compared to the conventional engine, nor restricts the coolant passage areas 20 along the cylinder head.

The sealing is easy, for instance by means of a rubber seal 18 inserted into a groove formed in the crankcase and being in touch to a properly shaped surface 19 around the cylinder head. The angular displacement of the control shaft can be manual, mechanical, hydraulic, electrical etc. Knock sensors and feedback control enable HCCI operation.

What is claimed is:

1. A variable compression ratio internal combustion engine comprising at least:

a base section (1), said base section (1) comprising a crankcase (2), said crankcase (2) comprising bearings (3), said base section (1) comprising a crankshaft (4) rotatably mounted on said crankcase (2) by means of said bearings (3) to rotate therein, said crankcase (2) comprising crankcase sliders (5), said crankcase (2) comprising crankcase projections (6);

a movable section (7), said movable section (7) comprising a cylinder (8), said movable section (7) comprising a cylinder head (9), said movable section (7) comprising cylinder sliders (10), said movable section (7) being slidably fitted on said crankcase (2) by means of said crankcase sliders (5) and said cylinder sliders (10), said cylinder sliders (10) supported on said crankcase sliders (5) pass the thrust loads of said cylinder (8) to said crankcase (2);

a working piston (11) slidably fitted into said cylinder (8);

a combustion chamber (12) formed between said cylinder (8), said working piston (11) and said cylinder head (9);

a control shaft (13), said control shaft (13) being pivotally mounted into said cylinder head (9), said control shaft (13) comprising eccentric pins (14);

connecting rods (15), said connecting rods (15) being pivotally mounted, at one end, on said eccentric pins (14), said connecting rods (15) being, at their other ends, pivotally mounted on said crankcase projections (6), the control shaft (13), supported on said crankcase projections (6), is bearing the cylinder head (9) and the forces from the combustion, the angular displacement of the control shaft (13) varies the compression ratio by displacing the cylinder head (9) relative to the crankcase (2) via the connecting rods (15).

2. A variable compression ratio internal combustion engine comprising at least:

a base section (1), said base section (1) comprising a crankcase (2), said crankcase (2) comprising bearings (3), said base section (1) comprising a crankshaft (4) rotatably mounted on said crankcase (2) by means of said bearings (3) to rotate therein, said crankcase (2) comprising crankcase sliders (5), said crankcase (2) comprising crankcase projections (6);

a movable section (7), said movable section (7) comprising a cylinder (8), said movable section (7) comprising a cylinder head (9), said movable section (7) comprising cylinder sliders (10), said movable section (7) being slidably fitted on said crankcase (2) by means of said crankcase sliders (5) and said cylinder sliders (10);

a working piston (11) slidably fitted into said cylinder (8);

a combustion chamber (12) formed between said cylinder (8), said working piston (11) and said cylinder head (9);

a control shaft (13), the combustion chamber (12) is arranged between the control shaft (13) and the crankshaft (4), the control shaft (13) is linked to the cylinder head (9), the control shaft (13) is linked to the crankcase projections (6), the control shaft (13), supported on the crankcase projections (6), is bearing the cylinder head (9) receiving the forces from the combustion, the angular displacement of the control shaft (13) varies the compression ratio by displacing the cylinder head (9) relative to the crankcase (2).

3. A variable compression ratio internal combustion engine according claim 2, wherein:

the control shaft (13) comprises eccentric pins (14), the control shaft (13) is pivotally mounted on the cylinder head (9), the control shaft (13) is linked to the crankcase projections (6) by means of first slider means (16) and of second slider means (17), said first slider means (16) are pivotally mounted on said eccentric pins (14), said first slider means (16) and said second slider means (17) being slidably fitted to each other.

4. A variable compression ratio internal combustion engine according to claim 2, wherein the control shaft is pivotally mounted on said cylinder head (7).

5. A variable compression ratio internal combustion engine according to claim 2, wherein the control shaft is pivotally mounted on said crankcase projections (6).

6. A variable compression ratio internal combustion engine according to claim 2, wherein there are more than one control shafts bearing the cylinder head.

7. A variable compression ratio internal combustion engine according to claim 2, wherein the control shaft comprises cams, the camming action of said cams displaces the cylinder head relative to the crankcase to vary the compression ratio.

8. A variable compression ratio internal combustion engine according to claim 2, wherein the control shaft comprises toothed gears, the toothed gears meshing with rack gears to displace the cylinder head relative to the crankcase.

9. A variable compression ratio internal combustion engine according to claim 2, wherein at least one of said pivotal joints and sliders comprises roller bearings.

10. A variable compression ratio internal combustion engine comprising at least:

a casing;

a cylinder, said casing and said cylinder are slidably fitted to each other;

a cylinder head secured on said cylinder;

a control shaft disposed into said cylinder head, the control shaft bears substantially the entire load applied on the cylinder head, the angular displacement of the control shaft varies the compression ratio by displacing the cylinder head relative to the casing.

* * * * *